US007318793B2

(12) United States Patent
Dubrul et al.

(10) Patent No.: US 7,318,793 B2
(45) Date of Patent: Jan. 15, 2008

(54) PUSH UP/PULL UP EXERCISE APPARATUS AND METHODS FOR USE

(76) Inventors: William Richard Dubrul, 1105 Maywood Dr., Belmont, CA (US) 94002; Richard E Fulton, 1556 Wellington Ave., Grand Junction, CO (US) 81501

( * ) Notice: Subject to any disclaimer, the term of this patent is extended or adjusted under 35 U.S.C. 154(b) by 428 days.

(21) Appl. No.: 10/702,611

(22) Filed: Nov. 7, 2003

(65) Prior Publication Data

US 2004/0102296 A1 May 27, 2004

Related U.S. Application Data

(60) Provisional application No. 60/424,890, filed on Nov. 8, 2002.

(51) Int. Cl.
*A63B 26/00* (2006.01)
*A63B 71/00* (2006.01)

(52) U.S. Cl. ..... 482/141; 482/62

(58) Field of Classification Search ..... 482/62, 482/141, 146, 77, 91, 907, 63, 121, 122, 482/127, 142; D21/665, 692
See application file for complete search history.

(56) References Cited

U.S. PATENT DOCUMENTS 1,985,432 A * 12/1934 Tucker et al. ..... 5/711
3,115,338 A 12/1963 Acs et al.
3,377,722 A * 4/1968 Downing ..... 36/7.8
4,196,903 A * 4/1980 Illustrato ..... 482/77
4,351,525 A 9/1982 Rozenblad
4,358,106 A 11/1982 Shadford
4,610,448 A 9/1986 Hill
4,621,806 A 11/1986 Wheeler
4,696,467 A * 9/1987 Markow ..... 482/77
4,776,586 A * 10/1988 Hardee ..... 482/80
4,854,573 A 8/1989 Johannson et al.
4,911,437 A * 3/1990 Schulkin ..... 482/124
5,065,465 A * 11/1991 Nystad ..... 5/680
5,112,045 A * 5/1992 Mason et al. ..... 482/9
5,181,897 A 1/1993 Agan
5,205,802 A 4/1993 Swisher
5,226,868 A 7/1993 Montgomery
5,607,380 A * 3/1997 Duty ..... 482/141
6,296,261 B1 * 10/2001 deGoma ..... 280/47.34
6,436,012 B1 * 8/2002 Naville ..... 482/77
6,832,979 B1 * 12/2004 Yarbrough ..... 482/77

* cited by examiner

*Primary Examiner*—Lori Amerson

(57) ABSTRACT

Exercise devices that have a novel mechanical that allow the force required to do push-ups, pull-ups or dips to be varied to aid with athletic training.

8 Claims, 3 Drawing Sheets

PUSH UP/PULL UP EXERCISE APPARATUS AND METHODS FOR USE

CROSS REFERENCE TO RELATED APPLICATION

The present invention claims the benefit of Provisional Patent application Ser. No. 60/424,890 filed Nov. 8, 2002, the full disclosures are incorporated herein by reference.

BACKGROUND OF THE INVENTION

1. Field of the Invention

The present invention is a pushup trainer that will assist the user by increasing or decreasing the force required by increasing or decreasing the weight of the user with the aid of a mechanical means such as a spring, spring bar, elastic bands, hydrodynamics, etc. while performing pushups.

2. Description of the Related Art

The benefits of performing pushups for increased upper body development are well known. Pushups are one of the best exercises for strengthening the triceps, pectorals, and deltoids. Unlike weight training, pushups can be performed without the need for a spotter, and place less stress on the joints.

Several other inventors have proposed various devices for increasing the benefits of performing pushups. However, no other inventor within the knowledge of the present inventor has proposed a pushup trainer having the advantages of the present invention. Specifically, no other pushup trainer provides for an aid of the user to decrease (or increase) the force required to do a push-up. For the majority of individuals, push-ups can be too difficult to do with any significant amount or without doing them from the knees. Hence individuals refrain from doing push ups because they loose enthusiasm. The present invention provides for a force-assist device that allows the user to decrease (or increase for those over zealous athletes) the force required to do push-ups. With this aid, the user can then do more push-ups and remain more enthused for this important strength training exercise.

U.S. Pat. No. 4,854,573 to Johannson discloses an exercise apparatus which has three hand grips having different elevations which are individually selectable to vary the degree of difficulty of push-up exercises. The Johannson device rests on a floor and is rotatable to a plurality of positions. While this device allows for different levels of difficulty, the range of difficulties that may be provided by this device is rather limited unless the device is built to an unduly and inconveniently large size.

U.S. Pat. No. 5,181,897 to Agan provides an exercise apparatus which relies on a non-planar surface other than a floor to enable a user to perform inclined push-up exercises. The Agan device includes angled brackets which are configured to conform to an edge of an object. However, the degree of difficulty which may be selected using this device is dependent upon whatever appropriate surfaces are accessible to a user. In certain circumstances, therefore, the range of difficulty levels which may be selected may be limited. Further, the Agan device is configured to receive an edge of an object in such a manner that the device may rock during normal exercise. Rocking during exercise tends to make the exercise more difficult and less enjoyable, while increasing the risk that the exercise device will become dislodged from the object upon which it is placed, thereby resulting in an injury to the user.

One example of a pushup trainer is U.S. Pat. No. 3,115,338, issued to Katherine and Peter Acs on Dec. 24, 1963.

This patent describes a pair of handles having a flat base. The base rests on the floor, while a person performing pushups grips the handles. The handles may have a base with a suction cup, so that the suction cup can attach to a wall, allowing the user to grasp the grip to maintain his balance. A third embodiment has a hook-shaped bolt, allowing the handles to hang from an overhead support for performing pull-ups.

U.S. Pat. No. 4,351,525, issued to William L. Rozenblad on Sep. 28, 1982, describes a pair of wood platforms, each having a non-skid surface on the bottom, and a U-shaped handle on top. The handles may be used in pairs for performing pushups, or only a single handle may be used to provide for a more difficult pushup.

U.S. Pat. No. 4,610,448, issued to David L. Hill on Sep. 9, 1986, describes a pushup training device having both handgrips pivotally attached to the same base. The U-shaped bracket supporting the handgrips can rotate around a vertical axis, and the handgrips can rotate around a longitudinal horizontal axis.

U.S. Pat. No. 5,205,802, issued to William J. Swisher on Apr. 27, 1993, describes a pushup training device having a single elongated base for a pair of handgrips. The base includes holes positioned at various differences from its vertical center, allowing the handgrips to be positioned at a desired distance from the center. The handgrips can rotate around a vertical axis as the user performs pushups.

U.S. Pat. No. 5,226,868, issued to Calvin W. Montgomery on Jul. 13, 1993, describes a pushup training device having a board and two C-shaped handles. The board has holes in various positions for attaching the handles. Only one end of the handles attaches to the board, allowing the handles to rotate around a vertical axis at the attachment point.

U.S. Pat. No. 5,607,380, issued to John E. Duty on Mar. 4, 1997, describes a pushup training device having a pair of bases, with each base supporting a gripping bar. The gripping bar may be positioned at various desired angles. An elastic band extends from one handgrip to the other, passing over the back of the neck, to provide a workout for the neck muscles as the user pushes him up.

U.K. Pat. No. 2,270,636, published on Mar. 23, 1994, describes a pushup-training device having a board and a pair of U-shaped handles. The board has several sets of holes, allowing the user to position each of the handles in a pair of holes. The user can thereby set the handles a desired distance apart.

German Pat. No. 4,229,970, published on Mar. 10, 1994, describes an exercise device.

Additionally, several devices have been used to facilitate the performance of push-up exercises. For instance, U.S. Pat. No. 4,351,525 to Rozenblad, U.S. Pat. No. 4,358,106 to Shadford, and U.S. Pat. No. 4,621,806 to Wheeler, disclose various devices for supporting one or more handgrips on a floor or other flat planar surface.

The above devices are somewhat limited in that they place the hand grips a fixed distance from the floor during exercise. Many people, however, are not strong enough to do regular push-ups (i.e., where the hands and the feet are placed roughly along the same plane, the floor). The difficulty of performing a push-up exercise decreases if the weight bearing on the arms is decreased. It is often beneficial to decrease the level of difficulty of push-up exercises, since many people lack the strength to do standard push-up exercises. This may occur for example because of a previous injury or age. Alternatively, it may be beneficial to decrease the level of difficulty so that the number of repetitions may-be increased, thereby providing a better overall workout.

None of the above patents describes a pushup trainer allowing the user to selectively choose a preferred force that is used for the push-up. Thus a push-up trainer solving the aforementioned problems (a need exists for a device for facilitating the performance of push-up exercises over a wide range of difficulty levels) is desired.

SUMMARY OF THE INVENTION

The present invention is a pushup trainer having a base and a top with a force controller in between. This controller allows the user to aid them by increasing or decreasing the force (usually decreasing).

One embodiment of the present invention is that the top is placed against the chest area and then a spring type mechanism is placed between it and the bottom/base. As the user goes down to begin their first push up, the spring like mechanism pushes up on their chest, removing some force on their arms. As the user begins to push up and complete the push up, the spring like mechanism pushes up thus decreasing the force required.

Another embodiment would be a ring that is made of a spring material that is placed between the chest area and the floor to assist with push-ups. As the user allows him/herself to go toward the floor, the ring goes from a circular shape to oblong to eventually a flat, squashed loop. Because it is made of a spring material (metal or plastic), the squashed loop has a pushing force that will aid in pushing the user back up to this or her original position with the arms extended. This force on the ring is easily changed with the addition/deletion of springs, elastomeric bands in the transverse/horizontal position, etc.

A unique feature of the present device is that it decreases resistance and assists the user in completing the exercise, and does so very simply. Most other exercise devices provide resistance by the means of weights, belts, elastic straps, or hydraulics. In other words, they tend to make the exercise more difficult, rather than providing a means to make the exercise easier.

To facilitate comfort, the device may be provided with a soft compressible covering. It may be contoured to fit the general shape of the human chest. It may be bolstered so that much of the weight of the user is supported by the center of the chest and the upper chest, i.e., the sternum and sternal area and the large upper pectoral muscles provide much of the support to the user. This would diminish the pressure on the breast region, and facilitate comfort for female users.

To facilitate additional exercise, the device may be used as a pull-up device to exercise, strengthen, and tone muscle groups not addressed by the push up routine. The user would stand on the device. Additional bands or spring tension, in the preferred embodiment, may be needed to support the full weight of the user.

To provide a bar or hand hold for the pull-ups, a handle is connected to a U-shaped bracket that fits over the top of a door. The bracket is positioned near the hinged side of the door so that the hinges support most of the weight of the exercise. The user simply positions the assist device of the present invention adjacent to the closed door so that the user is facing the door. The handle of the pull-up bar is parallel with the closed door. The user then stands on the assist device and does pull-ups. The pull-up device may be provided with handles that project perpendicular to the door for exercising additional muscle groups, i.e., the biceps.

Since the doorways in most homes will not provide enough vertical height to allow a full extension pull-up, i.e., one beginning with the arms fully extended, if most users stand on the assist device of the current invention fully erect, the user may elect simply to flex the knees to allow the arms to be fully extended at the onset of the exercise.

Alternatively, a separate frame may be provided for the pull up routine.

Additionally, the user may elect to sit on the device to perform other exercises. By sitting on the device and placing each hand on a chair seat, the assist device will facilitate exercises that target the triceps and shoulder girdle muscles.

Devices described herein are generally the size to fit beneath or above the athlete's/user's chest. There may be different sizes and shapes for difference sizes and shapes of users.

BRIEF DESCRIPTION OF THE DRAWINGS

FIG. 1 is an isometric view of the preferred embodiment of the instant invention, the 'Push-Up Exercise Apparatus' or 'Pull-Up Apparatus' or 'Dip Apparatus'.

FIG. 2 is an isometric illustration of the exercise apparatus of the instant invention with the user demonstrating the apparatus for use as a 'Push-Up Exercise' apparatus.

FIG. 3 is a schematic illustration of an embodiment of the present invention using a coil spring type of spring element.

These illustrations show only some potential configurations of the present invention. Other parametric changes of the present invention can occur such as location of the force element on the device as well as the actual type of mechanism(s) or element used.

DESCRIPTION OF PREFERRED EMBODIMENTS

Figure 1:
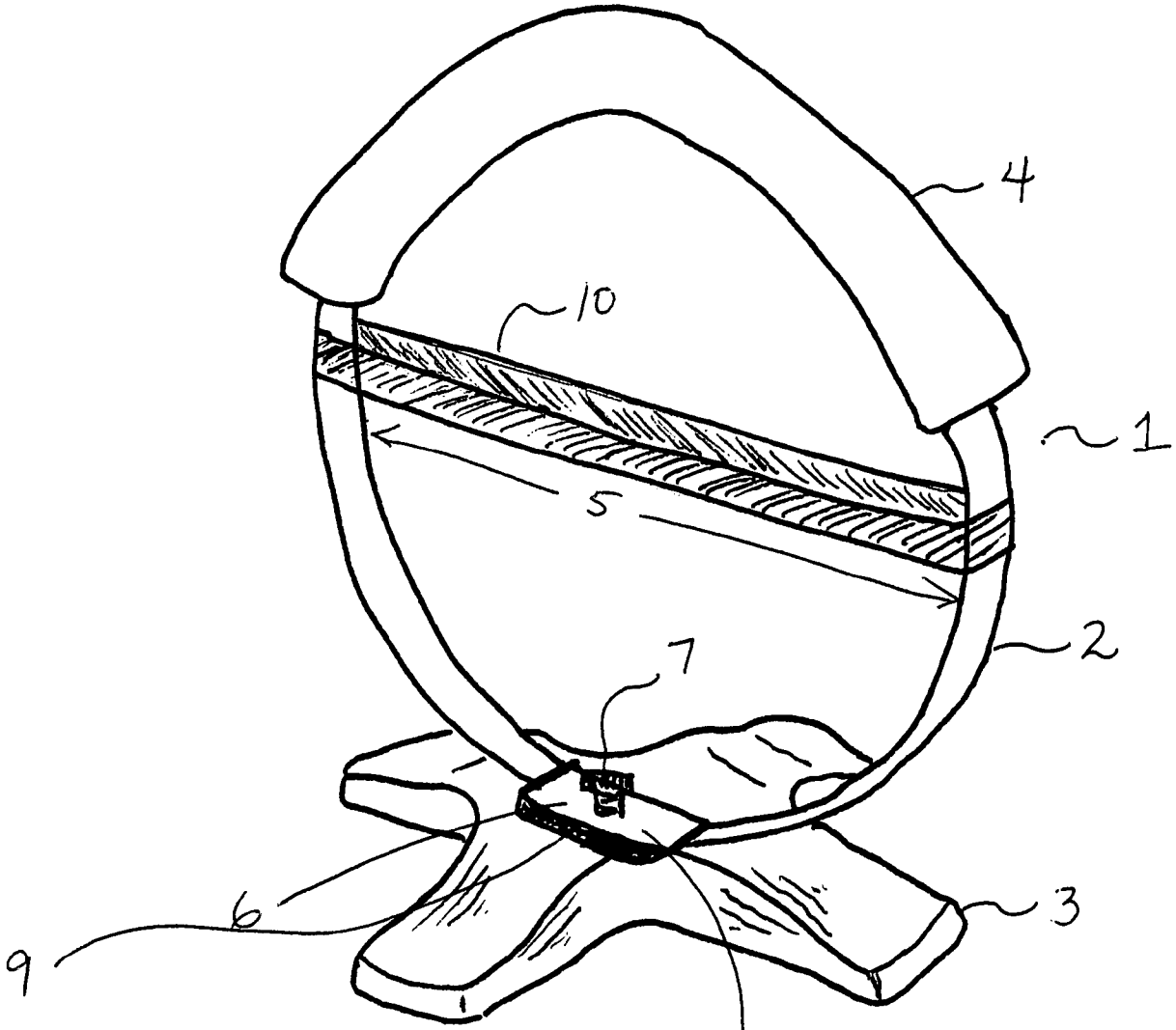
FIGS. 1, 2 & 3 are schematic illustrations of embodiments of the device constructed in accordance with the principles of the present invention.

FIG. 1 is an isometric drawing of the instant invention. This particular apparatus 1 is most suited to doing exercises such as push-ups, pull-ups or dips. The device 1 consists of a loop spring 2, a base 3 and a pad 4. The loop spring has been iteratively designed to add resistance (and subsequently help) to the user while doing exercise. The loop spring 2 is designed with a spring steel piece of flat stock spring steel that is approximately 0.036 inches thick and approximately 1.00 inches wide and approximately 132 inches long. The spring steel band or piece of flat stock is coiled into an approximate diameter 5 of 14 inches. This allows the spring steel band to be coiled three times around into the 14 inch diameter 5 circle. The steel ban is then fastened, usually with a rivet (not shown) to hold the looped spring steel in the circular shape in a 14-inch diameter 5. A hole (approximately 0.220 inches in diameter (not shown)) is then drilled through the three loops and centered for fastening the bottom 6 of the loop spring 2 to the base 3. This is most easily accomplished by screwing in a bolt with knob 7 into the base 3 and through the hole in the loop spring 2. The base 3 has a female thread centered in the base and directly below the screw 7. Additionally the base 3 has a crescent shaped groove 9 in the base 2 for holding the loop spring 2 in position in the base. Even further, a crescent shaped block 8 with a hole drilled through it approximately 0.220 inches in diameter fits on top of the loop spring 2. The screw 7 with knob is then placed through the loop spring 2 then the crescent block 8 and finally into the base 3 and tightened. The crescent block 8 provides additional support to the exercise apparatus once assembled. The base is usually made of a polymer plastic such as, but not limited to ABS plastic, which is molded into the preferred configuration show in FIG. 1. The base 3 has an approximate size of 14 inches by 14 inches as shown in the illustration. This base size allows the un-assembled apparatus to be easily packaged and stored with the base 3 fitting inside the loop spring 2. The pad 4 can be fabricated of several softer polymers such as polyurethane foam or other polymer foams. The pad provides a softer edge on the topside of the exercise apparatus and adds comfort to the user. In the case of push-ups, against the chest, in the case of dips, against the buttocks and in the case of pull-ups, against the feet. This pad can have a variety of configurations such as wet suit material or even cloth. It may be stitched or bonded to the loop spring 2 with a variety of glues commercially available.

Also illustrated in FIG. 1 is an elastic band 10 that is mounted near the mid diameter of the apparatus. This single band 10 adds spring force to the loop spring 2 so that if the user needs additional resistance while doing an exercise, the elastic band 10 can provide such additional assistance. This elastic band 10 can be of any of a variety of elastomeric materials such as natural rubber (e.g. rubber bands), butyl rubber, silicone rubber, polyurethane, etc. Additionally, although not shown is the fact that additional bands can be added to increase the resistive force. Prototypes were fabricated using as many as five rubber bands that significantly increased the resistive force.

Figure 2:
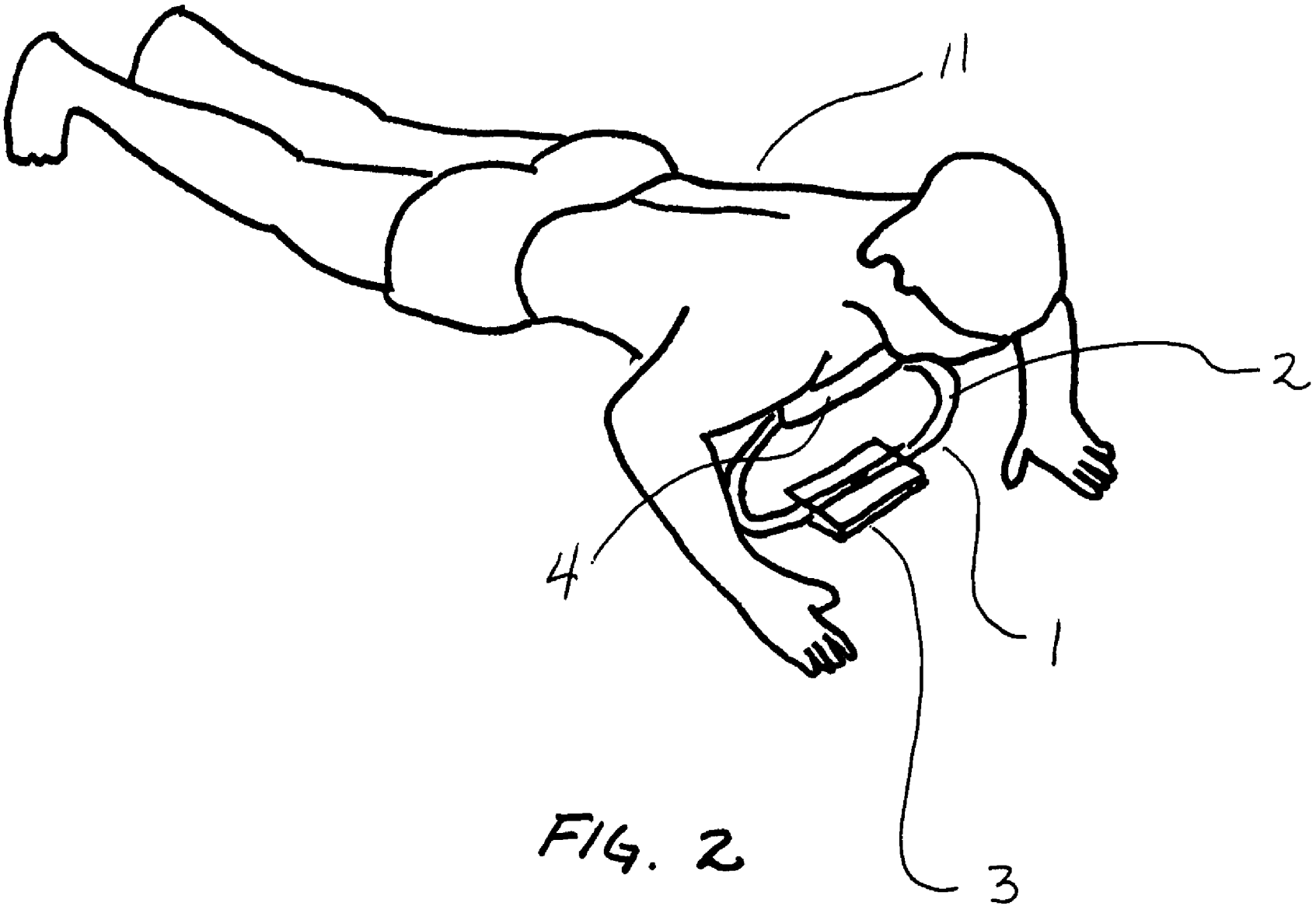

Turning now to FIG. 2, another isometric drawing of the instant invention is illustrated. In this particular embodiment, the user 11 is doing a push-up using the apparatus 1. The apparatus 1 is placed under the user's chest while doing the push-up. As the user 11 begins to do a push-up, the apparatus 1 is compressed as the user 11 allows his or her weight to be applied to the apparatus as the user is going downward. Once the user 11 reaches the floor or near the floor in his or her push-up, and he or she begins to push back up away from the direction of the floor, the apparatus applies a force to the user's body and aids with accomplishing the push-up. Not illustrated is the user 11 doing a dip or pull-up, but the same practice of the apparatus 1 applies to aiding with the force to help the user 11 do the exercise. In this illustration, the user 11 has the spring loop 2 oriented perpendicular to the bodyline, but the device has also been used parallel to the body line (not illustrated) between the breasts. Also not illustrated are the elastic bands 10 mentioned above. If additional force/assistance would be required by the user, these bands 10 could be added to FIG. 2 as is shown in FIG. 1.

Figure 3:
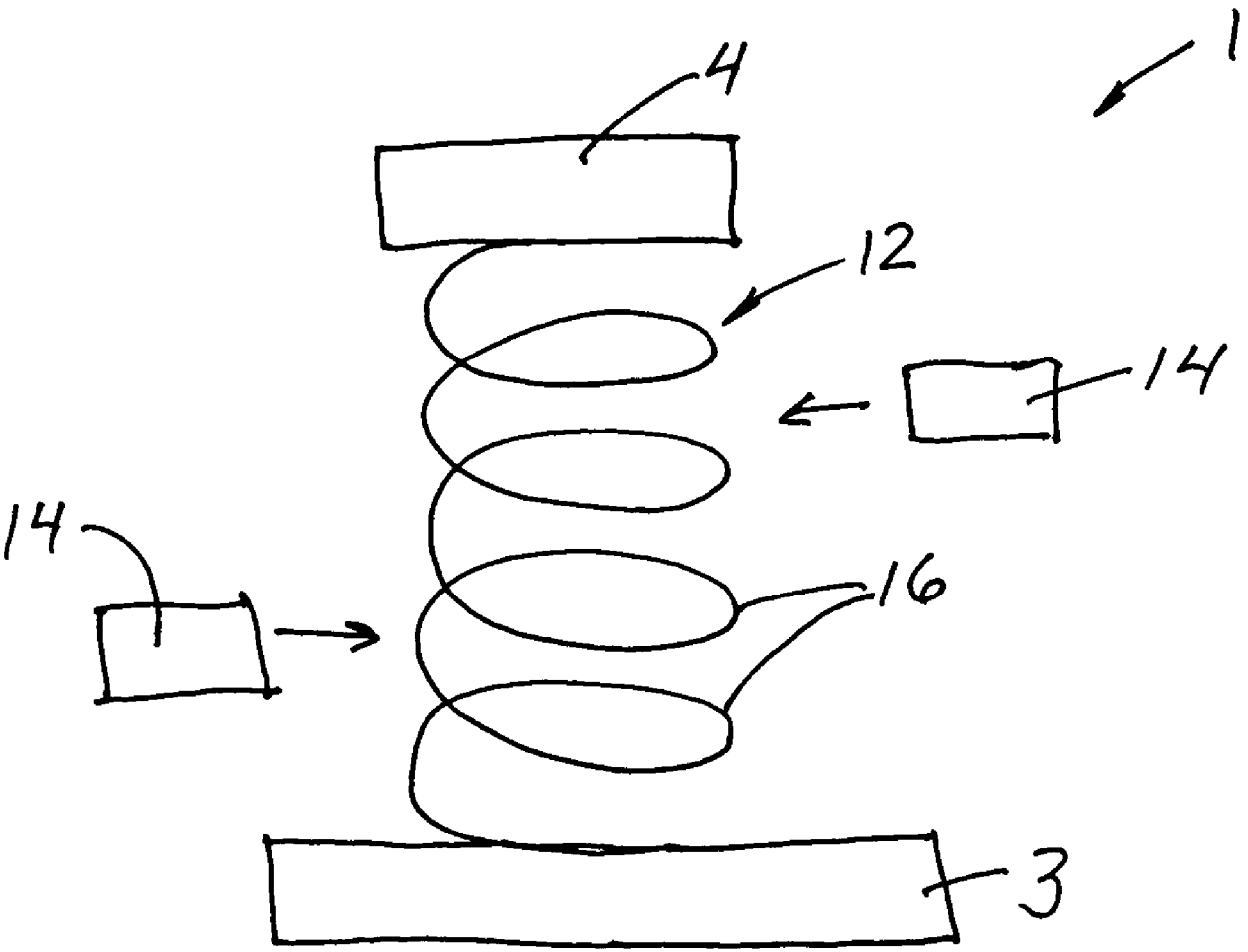

FIG. 3 schematically illustrates an apparatus 1 using a coil spring 12 type of spring element between a base 3 and a pad 4. Also illustrated are spacers 14 which can be added between the coils 16 of spring 12 to permit the compression force to be adjusted.

Although the foregoing invention has been described in some detail by way of illustration and example, for purposes of clarity of understanding, it will be obvious that certain changes and modifications may be practiced within the scope of the appended claims.

What is claimed is:

1. An exercice device comprising:
a geometric element with a relatively flat bottom;
a top comprising a compressible covering;
a spring element between the top and the bottom of the device, the spring element comprising an inflatable bag;
the device being sized for use as a push up exercise device;
whereby the distance from the top to the bottom of the device varies with the amount of force placed on the device during an exercise.

2. The device according to claim 1 wherein the exercise is a pull-up.

3. The device according to claim 1 wherein the exercise is a dip.

4. An exercice device comprising:
a geometric element with a relatively flat bottom;
a top comprising a compressible covering;
a spring element between the top and the bottom of the device;
whereby the distance from the top to the bottom of the device varies with the amount of force placed on the device during an exercise; and
elastic means for decreasing the force required to be exerted by a user during an exercise by adding an elastic element to the to the spring element.

5. The device according to claim 4 wherein the device comprises user-assemblable components.

6. The device according to claim 1 wherein the compressible covering is contoured to fit to the shape of the human chest.

7. An exercice device comprising:
a geometric element with a relatively flat bottom;
a top;
a coil spring between the top and the bottom of the device, the coil spring comprising coils;
spacers, the compression force between the coils being adjustable by adding spacers between the coils;
whereby the distance from the top to the bottom of the device varies with the amount of force placed on the device.

8. An exereice device comprising:
a geometric element with a relatively flat bottom;
a top;
a loop spring between the top and the bottom of the device;
an elastic band, the compression force between the top and the bottom of the loop spring being adjustable by adding at least one said elastomeric band around the loop spring;
whereby the distance from the top to the bottom of the device varies with the amount of force placed on the device.

* * * * *